US005165431A

United States Patent [19]

Tromblee et al.

[11] Patent Number: 5,165,431

[45] Date of Patent: Nov. 24, 1992

[54] AIR FLOW CONTROL FOR A DISHWASHER

[75] Inventors: Jon D. Tromblee, Hagar Township, Berrien County, Mich.; Wayne E. Kennedy, Ohio Township, Warrick County, Ind.

[73] Assignee: Whirlpool Corporation, Benton Harbor, Mich.

[21] Appl. No.: 635,490

[22] Filed: Dec. 28, 1990

[51] Int. Cl.[5] ..... B08B 3/10

[52] U.S. Cl. ..... 134/56 D; 134/102.1; 134/105

[58] Field of Search ..... 134/94, 95, 102, 105, 134/56 D, 58 D, 57 D; 34/34, 54, 14

[56] References Cited

U.S. PATENT DOCUMENTS

| | | | |
|---|---|---|---|
| 1,439,823 | 12/1922 | Kaufmann | 134/105 X |
| 1,916,806 | 7/1933 | Myrick | 134/102 |
| 2,081,636 | 5/1937 | Minors | 134/105 X |
| 2,154,559 | 4/1939 | Bilde . | |
| 2,422,022 | 6/1947 | Koertge | 134/105 |
| 2,597,359 | 5/1952 | McDonald et al. . | |
| 2,673,379 | 3/1954 | Jewell et al. | 134/105 |
| 2,674,249 | 4/1954 | Knight | 134/56 D |
| 2,734,122 | 2/1956 | Flannery | 134/105 X |
| 2,750,950 | 6/1956 | Inman et al. | 134/102 |
| 2,873,600 | 2/1959 | Demaret | 134/105 X |
| 2,907,335 | 10/1959 | Abresch . | |
| 2,918,068 | 12/1959 | Karig | 134/105 X |
| 2,935,207 | 5/1960 | Miller | 134/105 X |
| 3,026,628 | 3/1962 | Berger, Sr. et al. | 134/102 |
| 3,072,129 | 1/1963 | Seal . | |
| 3,103,227 | 9/1963 | Long | 134/105 |
| 3,130,737 | 4/1964 | Jellies | 134/57 D |
| 3,549,294 | 12/1970 | Kerr et al. . | |
| 3,698,406 | 10/1972 | Sato et al. . | |
| 3,739,145 | 6/1973 | Woehler | 134/105 |
| 3,807,420 | 4/1974 | Donselman et al. | 134/102 X |
| 4,195,419 | 4/1980 | Quayle | 134/102 |

FOREIGN PATENT DOCUMENTS 673859 12/1963 Canada .

*Primary Examiner*—Frankie L. Stinson

[57] ABSTRACT

An air flow control for a dishwasher is provided in which a spray pump motor has a blower wheel mounted thereon to provide cooling to the spray pump motor. The motor is positioned within an enclosed housing having an air inlet and two air outlets. One of the air outlets is provided with an air passage leading to an exit opening in a sump of the dishwasher. The sump communicates with the wash cavity of the dishwasher through a conduit and, during the wash and rinse portions of a washing cycle receives and retains a predetermined level of wash liquid. The air passage exit opening is positioned at an elevation below the predetermined wash liquid level in the sump so that during the wash and rinse portion of the wash cycle, air will be prevented from moving through the air passage into the wash cavity. However, once the wash liquid level drops below the predetermined level, air will be forced through the wash cavity.

17 Claims, 4 Drawing Sheets

AIR FLOW CONTROL FOR A DISHWASHER

BACKGROUND OF THE INVENTION

This invention relates to an air flow control apparatus and more particularly to an air flow control for a dishwasher.

The use of a fan fixed to a motor shaft to blow heated air into a wash cavity of a dishwasher to dry the articles within the dishwasher is well known. One known arrangement disclosed in U.S. Pat. No. 3,072,129 has a blower attached to the top end of a dishwasher motor drive shaft which causes air to be blown directly into the wash cavity during both wash and dry cycles. A disadvantage to such an arrangement is that blowing air into the wash cavity during the wash cycle causes poor wash performance by removing both heat and moisture from the wash cavity during the wash cycle. Such an arrangement also has the disadvantage of requiring a separate ducting means for the air flow and the water flow.

Another known air flow system disclosed in U.S. Pat. No. 3,698,406 uses a heater enclosure, consisting of a fan and heater coils, driven by the dishwasher motor drive shaft which causes heated air to pass through a ducting means and then into the wash cavity. A disadvantage to this system is that an additional heater and ducting means is required for the wash cycle.

SUMMARY OF THE INVENTION

It is an object of the present invention to provide a means for controlling air flow for dishwasher drying and motor cooling in a dishwasher. Another object of the invention is to provide an air flow control system that permits automatic air flow to the wash cavity when the spray water sump is empty. A further object of this invention is to provide an air flow control system which prevents air flow to the wash cavity when the spray sump is full. A still further object of the invention is to use one fan to both cool the drive motor and to provide drying air to the wash cavity. A still further object of the invention is to provide air not only from the fan, but also from the spray pump impeller through the spray arm during a drying portion of the cycle. Other objects of the invention will become apparent from the following description and specification.

An air control in accordance with the present invention avoids the problems of the prior art by using a blower wheel mounted on the top end of a spray pump motor shaft. A metal enclosure covers the spray pump motor and provides an air inlet port to the blower wheel. When the spray pump motor operates, room air is drawn into the metal enclosure to cool the motor. If the dishwasher is in a wash or rinse cycle, air from the blower wheel is prohibited from entering the wash cavity by water blocking its path in the sump. The blower wheel creates insufficient air pressure to displace this water. Instead, the warmed air is discharged to the room through an enclosure exhaust vent.

When the sump is empty, as during a drain or dry cycle, air from the blower wheel, which has been warmed by passing over the motor, flows through the spray sump and is passed over the wash liquid heater coil also located in the spray sump and then is automatically discharged into the wash cavity. A small portion of the total air flowing into the wash cavity is supplied by the spray pump impeller, through the spray arm.

The result of the disclosed of air control system is a dishwasher that utilizes a single ducting means to deliver both drying air and wash liquid to the wash cavity. Also, due to the inherent design of the system, air flow to the wash cavity is automatically controlled by the amount of wash liquid in the spray sump. This prevent air flow into the wash cavity during the wash and rinse cycle when the spray sump is full of water.

DESCRIPTION OF THE PREFERRED EMBODIMENTS

Figure 1:
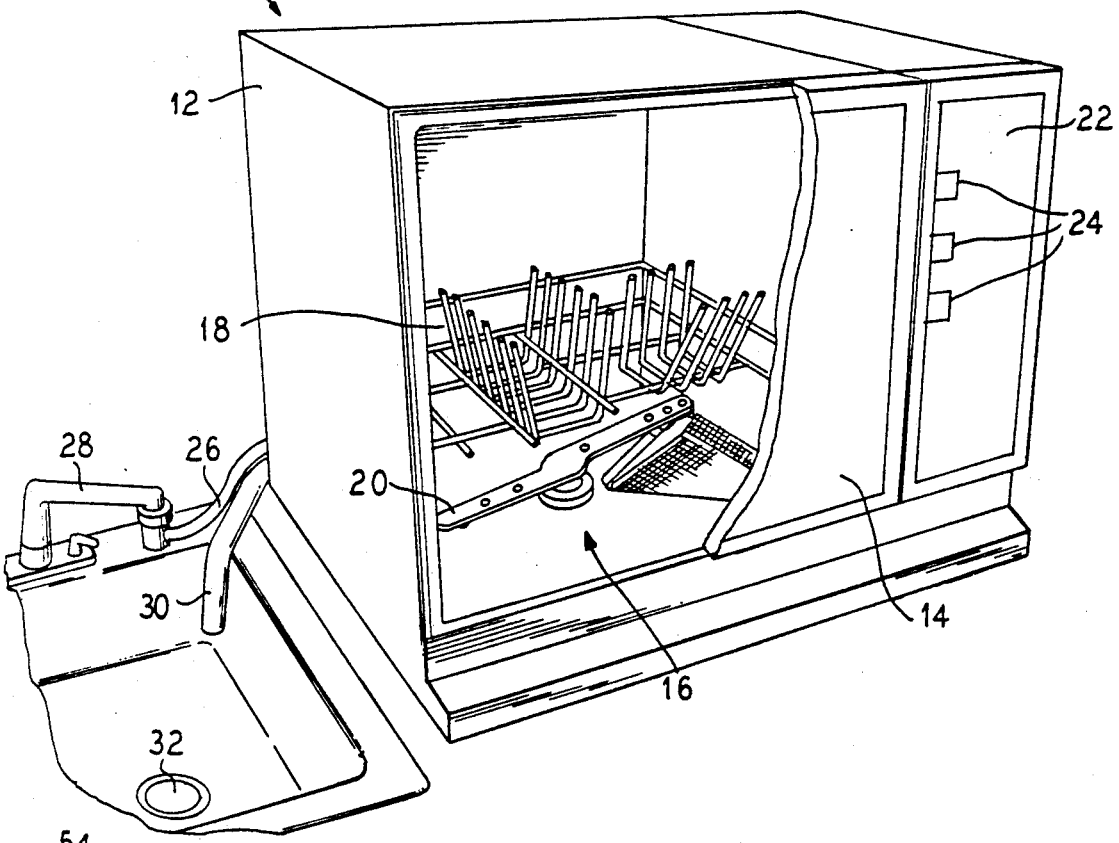
FIG. 1 is a perspective view of an automatic dishwasher incorporating the principles of the present invention.

FIG. 1 shows a dishwasher 10 having a cabinet 12 and an openable door 14. A wash chamber 16 of the cabinet 12 houses dish supporting racks 18 and a rotating spray arm 20.

A control panel 22 is provided with a plurality of controls 24 for pre-selecting the desired cycle of operation for the dishwasher.

Since the dishwasher 10 embodying the principles of the present invention may be a countertop style dishwasher, a water inlet hose 26 is shown as being connected to a kitchen faucet 28 and a drain hose 30 is shown as being directed toward a kitchen sink drain 32. Of course, the dishwasher 10 could be a built-in unit, in which case the water inlet line 26 and the drain line 30 would be permanently connected to the house plumbing.

As seen in FIG. 1, there is a dish rack 18 provided in the dishwasher. The rack may be provided with rollers 33 (FIGS. 5 and 6) for easy movement of the rack. Preferably, the rack is formed of welded wire with a plastic coating. The wire form of the dish rack is designed so as to minimize interference of the rack with spray from the spray arm 20.

Figure 2:
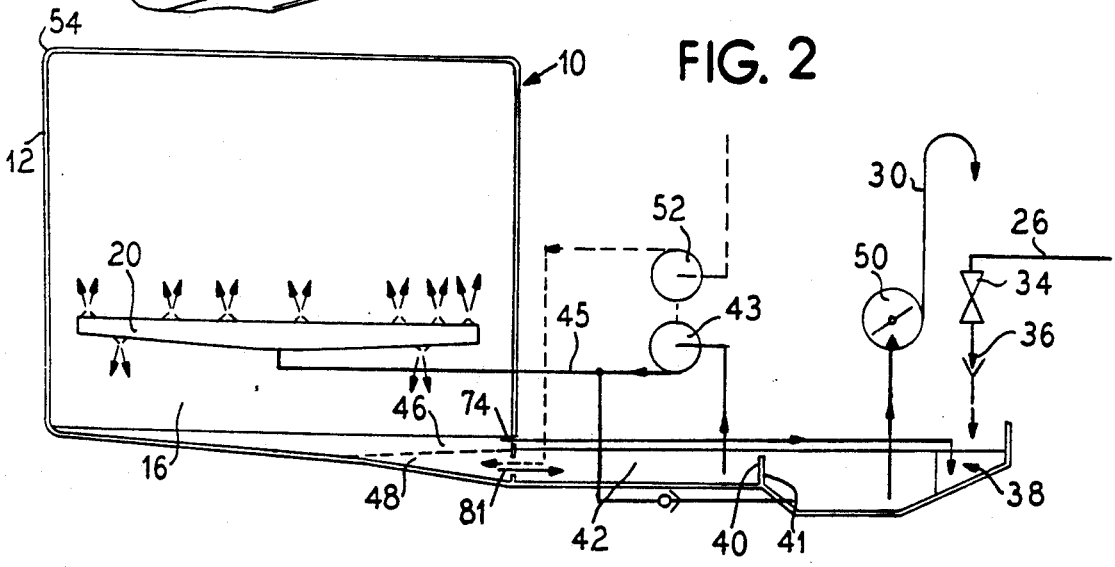
FIG. 2 is a schematic illustration of the fluid flow patterns through the dishwasher of FIG. 1.

FIG. 2 shows a schematic illustration of the fluid flow patterns within the dishwasher 10. In the schematic illustration the water inlet line 26 is shown at the far right, where it is seen that water first passes through a fill valve 34 which is operated by the dishwasher control 24. The inlet water then passes through a vacuum break 36 and into a settling chamber/drain sump 38. From the settling chamber/drain sump 38, water flows through an opening 40 in a separating wall 41 into a spray sump 42. From the spray sump 42 water is drawn by a spray pump 43 driven by a motor 44 (FIG. 4) and directed to the spray arm 20 within the wash chamber 16 through a connecting conduit 45. Water from the wash chamber 16 partially flows to a first trough 46 through an opening 74 and into the settling chamber/drain sump 38 and partially to a second trough 48 through an opening 81 and back to the spray sump 42. At various times during the wash cycle, when it is desired that the wash liquid be removed from the dishwasher, a drain pump 50 driven by a motor 51 (FIG. 4) draws wash liquid from the settling chamber/-drain sump 38 and directs it to the drain line 30.

During a drying portion of the wash cycle, room air is drawn in by a blower or fan 52 operated by the spray pump motor 44. The air is directed in through the second trough 48 to flow through the wash chamber 16 to be vented through an opening 54 preferably located near the front top portion of the dishwasher cabinet 12.

Figure 3:
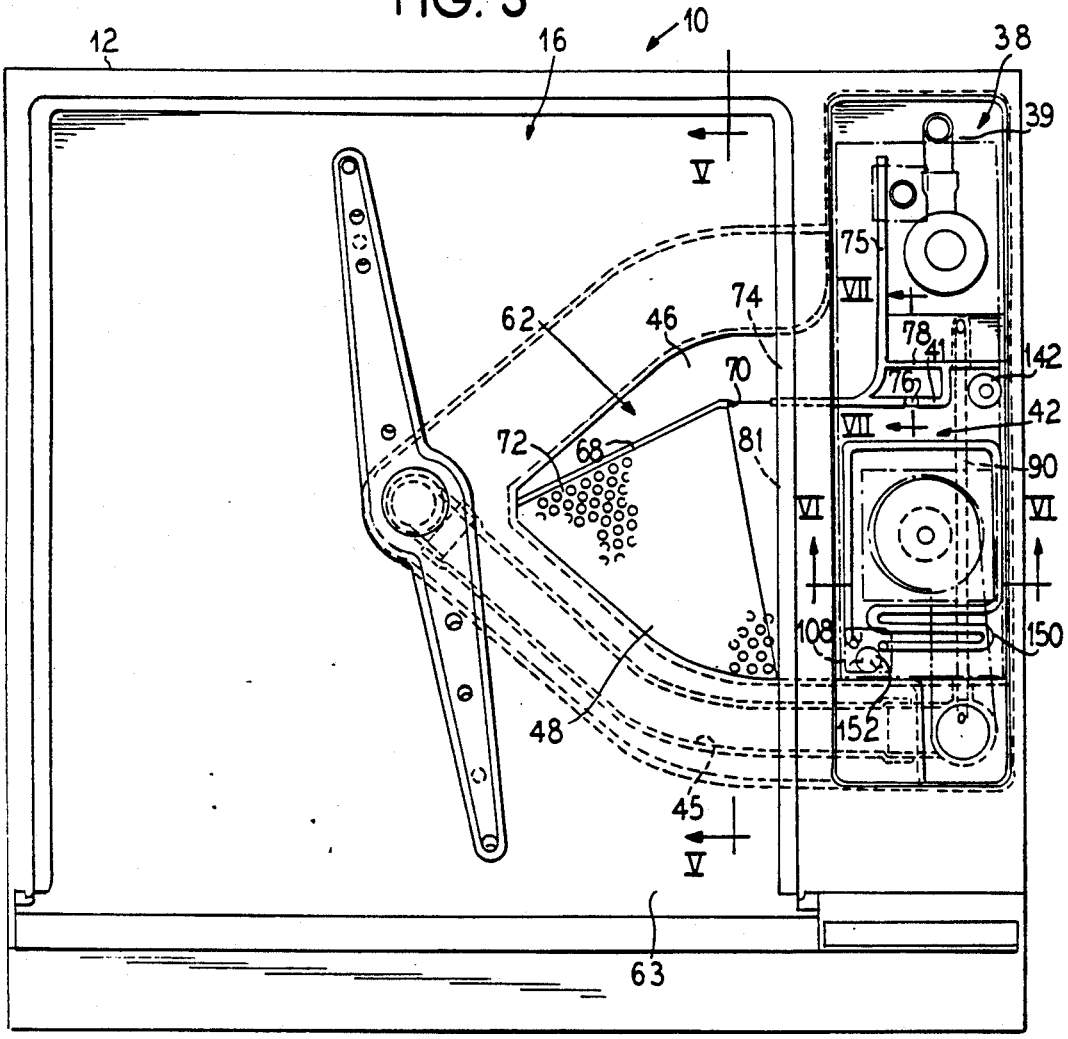
FIG. 3 is a plan or top view of the base portion of the dishwasher of FIG. 1.
Figure 5:
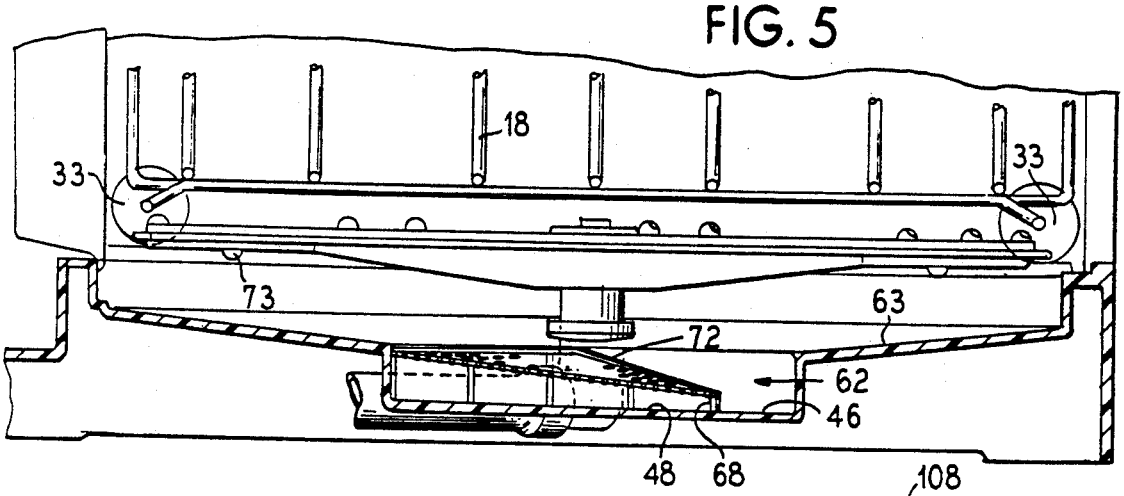
FIG. 5 is a side sectional view of the wash cavity and sump inlet areas taken generally along the line V—V of FIG. 3.
Figure 6:
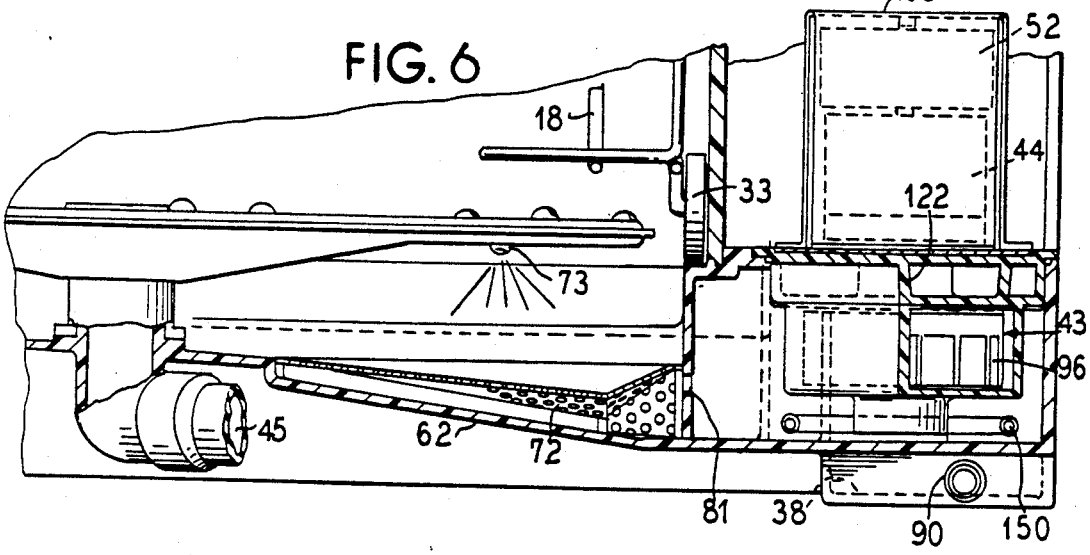
FIG. 6 is a side sectional view of the wash cavity and sump inlet areas taken generally along the line VI—VI of FIG. 3.

As best seen in FIGS. 3 and 5, wash liquid drains from the wash cavity 16 by means of a depressed area or sump 62 which preferably is molded into a bottom wall 63 of the wash chamber. The depressed area 62 is divided into the two troughs 46, 48 by a dividing wall 68 which extends along most, but not the entire length of the depressed area 62. There is a communicating opening 70 through the wall 68 between the two troughs 46, 48 which assists in the draining of the dishwasher. The two troughs are of unequal size, and the larger trough 48 leads to the spray sump 42, and is covered with a filter screen 72 which permits passage of liquid, but which inhibits passage of food particles.

The screen 72 is sloped downwardly toward the smaller trough 46, and thereby assists in the movement of soil particles toward the first trough.

Also, the spray arm 20 has at least one downwardly directed nozzle opening 73 which directs a spray of wash liquid against the screen 72 (FIG. 6) to assist in the cleaning of the screen and directing food particles to the first trough 46. Spray arm rotation is set so that the cleaning spray can sweep soil directly off of the filter screen 72 and into the first trough 46 leading to the settling chamber/drain sump 38. The first trough 46 leads to an opening 74 communicating with the settling chamber/drain sump 38 which is located at the lowest elevation of the dishwasher cabinet.

The settling chamber/drain sump 38 is crucial to the operation of the dishwasher, in that it enables the dishwasher to achieve an acceptable level of wash results with just four fills and one detergent addition. The settling chamber/drain sump 38 removes both lighter-than-water and heavier-than-water soils from the recirculating wash liquid. These soils are trapped in the settling chamber/drain sump 38, in which the drain pump 50 is located, so that they are disposed of quickly during the pump-out process. The settling chamber/-drain sump 38 includes an isolated chamber 39 to which soil-laden water is directed from the trough 46 in the dishwasher base unit. The entry opening 74 to the settling chamber/drain sump 38 has its top **74*a* above the operating wash liquid level. This allows floating soil to enter the chamber and prevents it from being trapped in the main washing compartment 16**.

Figure 7:
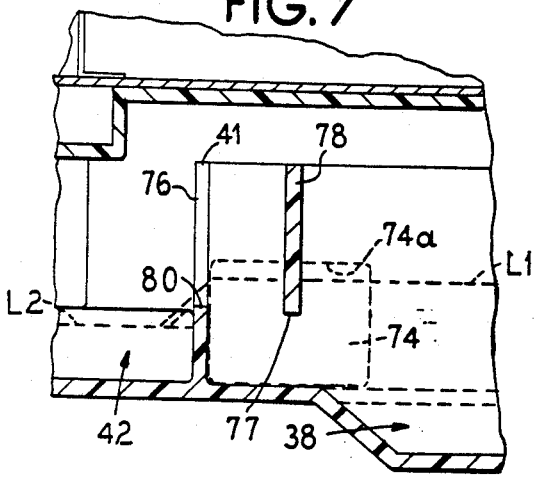
FIG. 7 is a side sectional view of the sumps separating wall taken generally along the line VII—VII of FIG. 3.
Figure 8:
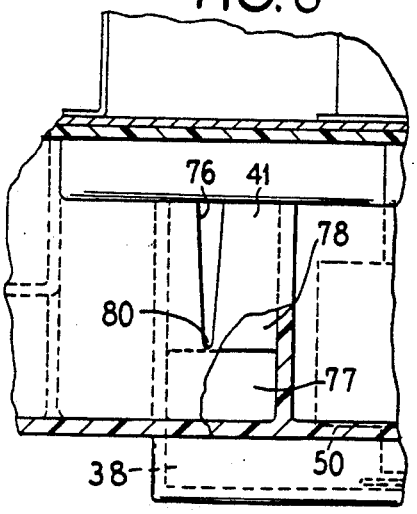
FIG. 8 is a side sectional view in the spray sump taken generally along the line VIII—VIII of FIG. 9.

The flow through the settling chamber/drain sump 38 is carefully controlled to reduce turbulence and allow soils to settle (or float) out of the wash/rinse fluid. Within the settling chamber/drain sump 38 there is a baffle wall 75 which prevents turbid fluid from the wash chamber 16 from flowing directly into the isolated chamber 39. During the wash cycle, as fluid flows through the trough 46 into the settling chamber/drain sump 38, it is permitted to flow then into the spray sump 42 through the opening 76, which is in the form of a V-shaped notch (FIGS. 3,7 and 8) formed in the wall 41 that isolates the settling chamber/drain sump from the spray sump.

The V-notch 76 is sized so that a flow rate of approximately one half gallon per minute is maintained through the V-notch when the spray pump 43 is operating. The flow of wash liquid from the settling chamber/drain sump 38 to the spray sump 42 is directed through an opening 77 (FIGS. 7,8) under an appropriately spaced wall 78 so that floating soil is trapped in the settling chamber/spray sum before it gets to the V-notch 40. A bottom 80 of the V-notch 40 is high enough to trap heavy soil that has settled to the bottom of the isolated chamber 39. The flow velocity through the settling chamber/drain sump 38 is normally relatively slow, thus allowing heavier-than-water soils to settle, and lighter-than-water soils to rise.

The screen 72 provides a small impedance of the flow of wash liquid from the wash cavity sump 62, through an opening 81 communicating with the spray sump 42. This impedance produces a wash liquid level that is higher in the settling chamber/drain sump 38 than the level in the spray sump 42, and provides the driving force that gives the above-mentioned one half gallon per minute separator flow.

The system described is self-regulating. In the exemplary embodiment, the settling chamber/drain sump 38 is designed for a one half gallon per minute flow of relatively clean wash liquid. When heavy soils are encountered, the protecting filter screen 72 may become partially blocked. This increases the flow impedance to the spray pump 43 and creates a greater fluid level difference between the spray sump 42 and the isolated chamber 39 of the settling chamber/drain sump 38. As the fluid level in the spray sump 42 drops, the effective fluid passage area through the V-notch 40 increases. The result is that the fluid flow rate through the V-notch 40 increases until the heavy soil is pulled from the surface of the screen 72 and into the settling chamber/-drain sump.

As a result, the filter screen blockage has been eliminated, flow impedance is returned to normal, and then flow through the settling chamber/drain sump returns to the one-half gallon per minute rate. The result is very rapid removal of large soil particles from the wash water followed by removal of the fine soil particles. The slow relatively turbulence-free flow through the settling chamber/drain sump 38 also minimizes the suspension and homogenizing action that occur between detergent and soil in a highly agitated system. The result is that little detergent is used by the soil trapped in the settling chamber/drain sump 38. This means that more detergent remains available in the water for cleaning of the dishes, or, alternatively, less detergent addition is needed to perform the cleaning function.

At appropriate times during the wash cycle the wash liquid within the dishwasher is pumped by drain pump 50 through the drain line 30 to remove wash liquid and collected soil particles from the dishwasher. A soil chopper 82 (FIG. 4), including a single wire pressed at a right angle through an extension 84 of the pump impeller, is located just below an impeller opening 86 of the drain pump 50. The proximity of the chopper 82 to the impeller opening 86 is chosen such that the chopper 82 chops all soil to a size that can pass through both the pump 50 and the drain hose 30 of the system. A pump capacity of approximately one gallon per minute has been determined to be sufficiently large to provide the necessary pump out operation.

A separate drain line 90 (FIG. 4) is provided between the spray conduit 45 and the drain pump 50 to permit a pump out of all wash liquid within the system. The drain line 90 includes a check valve 92 which is closed when the spray pump 43 is in operation, but which moves to an open position, allowing draining to the settling chamber/drain sump 38, when the spray pump 43 is not in operation.

Both the spray pump 43 and drain pump 50 of the power system are designed to operate without pump seals. This is facilitated by the fact that both of the motors are well above the operating wash liquid level. To facilitate the no-seal design, impellers 94, 96 of the pumps 50, 43 have pumping elements or impeller blades 98, 100 on both sides. The pumping element 100 on the motor side of the impeller counteracts the pressure developed by the main impeller pumping element 98. This prevents pressurized water from escaping through a clearance space 102 between a motor shaft 104 and the pump body 106. This design eliminates both manufacturing and service costs associated with pump seals. It also allows the pumps to be run "dry" with no chance for seal damage.

Since running dry is possible, the spray pump motor 44 is fitted with the fan 52 that serves both to cool the motor and to provide forced air for drying within the dishwasher. A cover 108 is provided which surrounds the motors 44, 51 and fan 52, and which is secured to a subassembly base 110 carrying the motors 44, 51 by an appropriate fastener arrangement such as a tab in groove connection 112 at one end 114 and a wire rod clip 116 secured between the cover 108 and the dishwasher base 118 at an opposite end 120.

The subassembly base 110 has a passage 122 molded therein which permits air from outside the cover 108 to be drawn into an area 124 enclosed by the cover 108. More particularly, the air is drawn through the passage 122 into openings 126 which are within a separate cover 128 enclosing the motor 44. The air is then drawn through an opening 130 in the motor cover 128 into the fan 52 which then pressurizes the area 124 within the cover 108.

Figure 9:
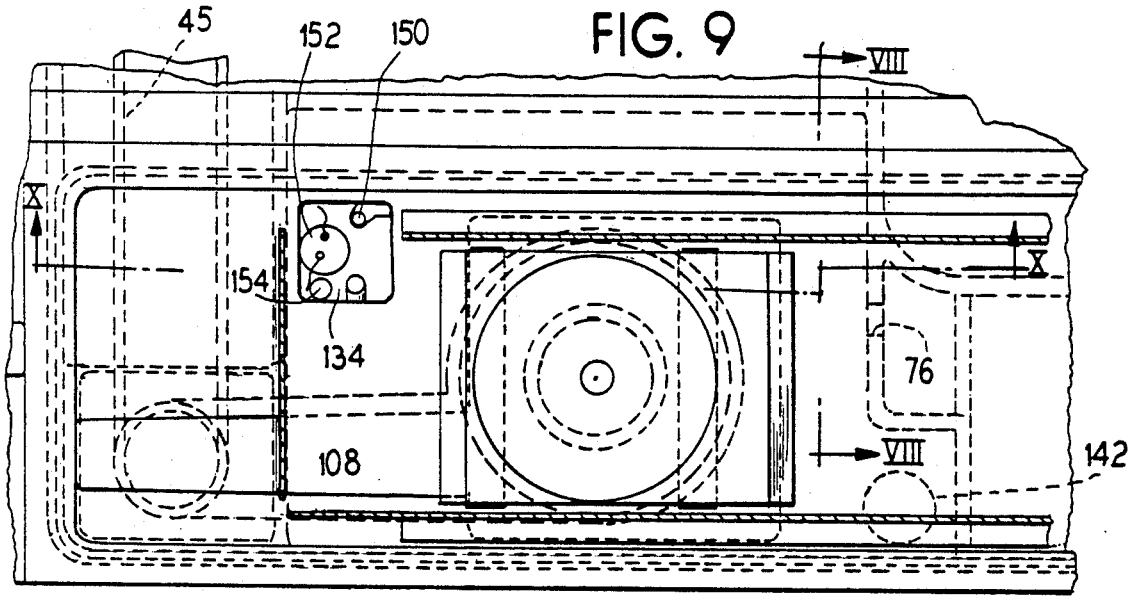
FIG. 9 is a top sectional view of the electrical module taken generally along the line IX—IX of FIG. 4.
Figure 10:
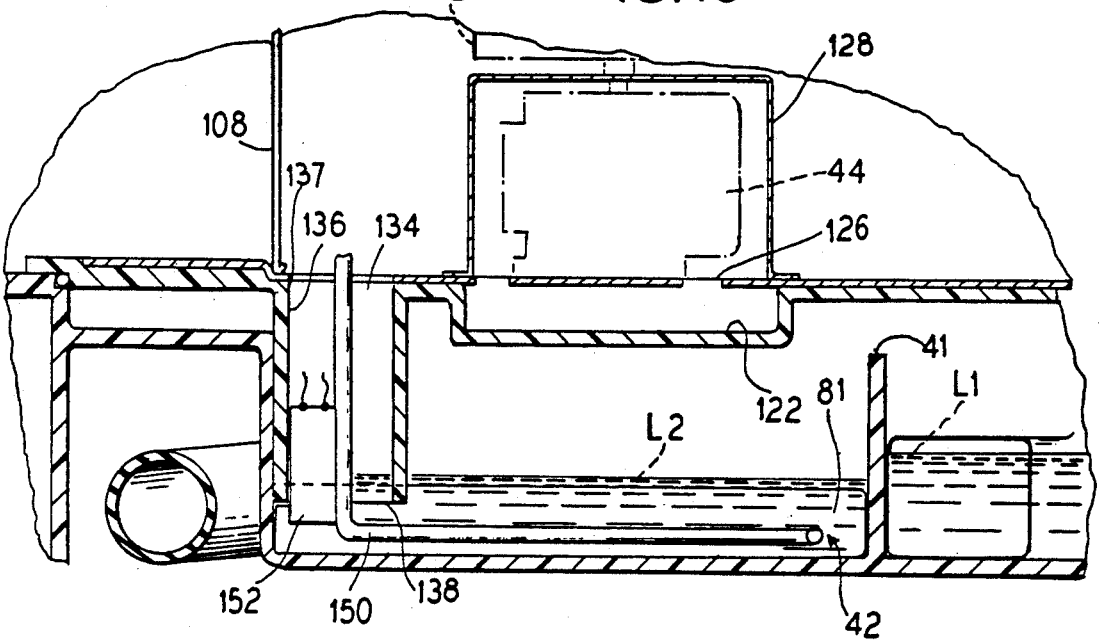
FIG. 10 is a side sectional view of the spray sump taken generally along the line X—X of FIG. 9.

Two air outlets are provided for the pressurized air. A first outlet 132 is one or more small vent openings in the cover 108 leading back into the area enclosed by the dishwasher cabinet 12. A second outlet 134 (FIGS. 9, 10) leads to the washing chamber 16; however, this outlet is designed so that no air can flow through the washing compartment 16 when the machine is operating in a wash or rinse mode. This is accomplished by providing an air duct 136 having an inlet opening 137 open to the interior of the cover 108 and an outlet opening 138 open to the spray sump 42. The outlet opening 138 to the spray sump 42 is covered by wash (or rinse) liquid at level L2 or higher when the machine is in the wash (or rinse) mode of operation.

When the liquid is pumped out of the sumps 38, 42, the liquid level therein drops below the outlet opening 138, thus permitting air from the interior of the housing 108 to flow through the air duct 136. Since the outlet opening 138 provides a larger cross-sectional area for air flow than the first outlet 132, most of the air flow generated by the fan 52 passes through the air duct 136 and into the spray sump 42. From the spray sump 42, the air flows directly into the washing chamber 16 through the channel 48 and through the screen 72, thus drying the screen. Further, since the motor 44 that runs the fan 52 also runs the pump 43, air will be pumped through the spray arm 20 and will therefore dry out the interior of the spray arm.

Air control through the wash chamber 16 is needed since it is undesirable to have air flowing through the dishwasher during washing and rinsing. Excessive moisture and heat losses would occur should pressurized air be introduced into the wash cavity during the wash or rinse mode. When the machine is washing or rinsing, the spray pump fan 52 still provides cooling air for the pump motor 44. The air path through the wash chamber (drying air) presents significantly lower resistance to airflow than the vent openings in the cover 108; hence the air path through the wash chamber is the principal path used when the machine contains no wash liquid.

Figure 4:
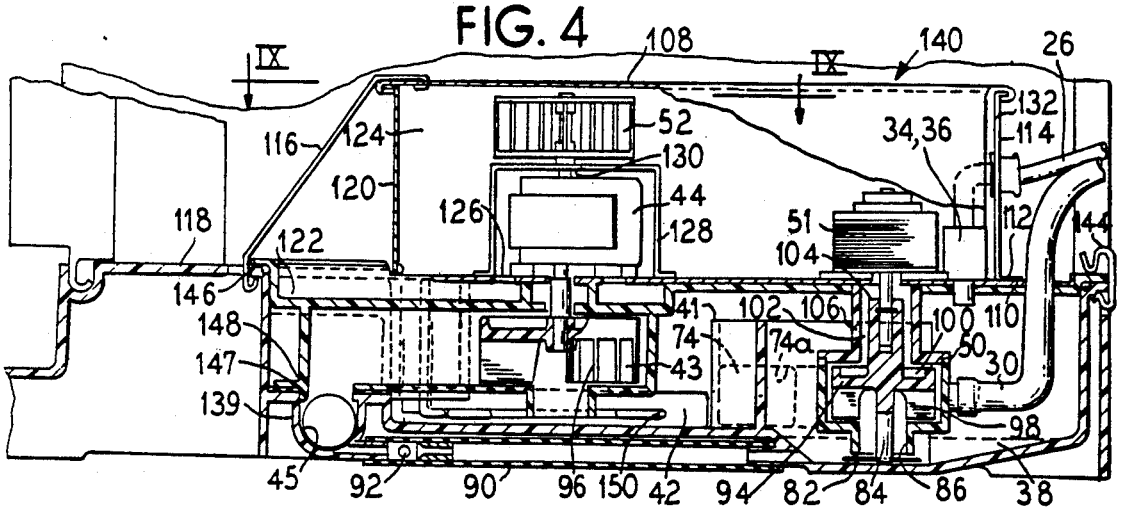
FIG. 4 is a side sectional view of the sumps and pumps area taken generally along the line IV—IV of FIG. 3.

In order to reduce manufacturing costs, the dishwasher may be constructed in a modular fashion with many of the structural components molded as a unit. For example, the washing compartment may be molded as a single unit. Also a molded base unit 139 may be provided which contains both the settling chamber/drain sump 38 and the spray sump 42 as well as the above described walls 75, 41. A power module 140 (carried on the subassembly base 110) may be provided which carries the drain pump 50 and its motor 51, the spray pump 43, its motor 44, and the fan 52, as well as other components such as an overfill protect float 142 (FIGS. 3 and 9) and fill valve 34 and vacuum break 36 (FIG. 4). The power module 140 can be assembled onto the base unit 120 by a minimum of fasteners, such as a clip 144 and the connecting rod 116 with a seal 146 being provided between the two units. A seal member 147 is also provided where an outlet 148 of the spray pump 43 joins the connecting conduit 45 leading to the spray arm 20.

The spray pump 43, located at the front of the power module 140, is centered in the spray sump 42 molded in the base unit 139. The pump 43 is surrounded by a tubular electrical heating element 150. The heating element 150 is formed in a simple geometric shape to heat fluid throughout the sump 42, and is carefully located so that it is spaced away from direct contact with any of the molded plastic parts of the system. In the exemplary embodiment, heating element power is 1200 watts and provides a temperature rise of about 3° fahrenheit per minute. The spray pump flow rate is approximately eight gallons per minute.

The control system may either be electronic or electromechanical. In the illustrated embodiment, the control is designed for a timed- fill with a float switch overfill protection. The control is designed to be a complete subassembly located at the dishwasher front to the right of the washing compartment 16. The control provides a temperature hold on selected parts of the cycle. A 140° fahrenheit temperature hold thermostat 152 is installed in the machine power module along with a second safety thermostat 154 that shuts off the water heater element 150 in the event of an over-temperature condition. The safety thermostat 154 operates independently of the control module.

As is apparent from the foregoing specification, the invention is susceptible of being embodied with various alterations and modifications which may differ particularly from those that have been described in the preceding specification an description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a dishwasher having a wash cavity, a wash liquid sump, which is isolated from said wash cavity by at least one wall for receiving and retaining wash liquid during wash and rinse portions of a washing cycle, said wash liquid being maintained at a predetermined level in said wash liquid sump during operation of said dishwasher, and conduit means for providing fluid communication between said sump and said wash cavity, an air flow control comprising:

blower means for moving air, an air passage leading from said blower means to an exit opening in said sump;

means for preventing flow of air through said air passage into said sump when said wash liquid in said sump is above said predetermined wash liquid level.

2. An air flow control according to claim 1, wherein said means for preventing flow of air comprises said exit opening in said sump being located below said predetermined wash liquid level.

3. An air flow control according to claim 1, wherein said blower means comprises a blower fan and a motor for driving said blower fan all enclosed within a housing, said housing having an air inlet and at least one air outlet comprising said air passage.

4. An air flow control according to claim 3, wherein said dishwasher further includes a pump means located in said sump for causing a fluid flow between said sump and said wash cavity, said pump being driven by said motor.

5. An air flow control according to claim 3 including at least one additional air outlet from said housing separate from said air passage providing an exit for air drawn into said housing by said blower when said air is prevented from flowing through said air passage into said sump.

6. An air flow control according to claim 5, wherein when said wash liquid in said sump is below said predetermined level, air flow through said air passage is restricted less than air flow through said additional outlet.

7. An air flow control according to claim 1 further including a second air passage leading from said wash cavity to the exterior of said dishwasher.

8. A dishwasher comprising:

at least one wall defining a wash cavity;

a wash liquid sump for receiving and retaining a predetermined level of wash liquid during wash and rinse portions of a washing cycle;

conduit means for providing fluid communication between said sump and said wash cavity;

pump means for causing a fluid flow between said sump and said wash cavity;

a motor for driving said pump means;

a housing surrounding said motor, said housing having an air inlet and at least one air outlet;

blower means driven by said motor and operable to move air into said housing through said inlet and to cause air to be directed to said outlet; and an air passage leading from said outlet to an exit opening in said sump;

said air passage exit opening being positioned at an elevation below said predetermined wash liquid level in said sump during said wash and rinse portions of the washing cycle, wherein, when said wash liquid level is above said exit opening, air will be prevented from exiting through said opening.

9. A dishwasher according to claim 8 further including a heater element located within said wash liquid sump wherein air flowing into said wash cavity from said blower means will have passed over said heater element.

10. A dishwasher according to claim 8 including an air passage leading from said cavity to the exterior of said dishwasher.

11. A dishwasher according to claim 8, wherein said housing has a second air outlet not connected to said air passage.

12. An air flow control according to claim 11, wherein when said wash liquid in said sump is below said predetermined level, air flow through said air passage is restricted less than air flow through said second air outlet.

13. A dishwasher comprising:

at least one wall defining a wash cavity;

a wash liquid sump for receiving and retaining a predetermined level of wash liquid during wash and rinse portions of a washing cycle;

conduit means for providing fluid communication between said sump and said wash cavity;

pump means located in said sump for causing a fluid flow between said sump and said wash cavity;

a motor for driving said pump means, said motor being located above said pump means;

a blower driven by said motor, said blower located above said pump means;

a housing surrounding said motor and blower, said housing having an air inlet and two air outlets;

said blower operable to draw air into said housing through said inlet and to cause air to be directed to said two outlets; and an air passage leading from one of said outlets to an exit opening in said sump;

said air passage exit opening being positioned at an elevation below said predetermined wash liquid level in said sump during said wash and rinse portions of the washing cycle, wherein, when said wash liquid level is above said exit opening, air will be prevented from exiting through said opening.

14. A dishwasher according to claim 13 further including a heater element located within said wash liquid sump wherein air flowing into said wash cavity from said blower means will have passed over said heater element.

15. A dishwasher according to claim 13 further including an air passage leading from said cavity to the exterior of said dishwasher.

16. A dishwasher according to claim 13, wherein said housing has a second air outlet not connected to said air passage.

17. An air flow control according to claim 13, wherein when said wash liquid in said sump is below said predetermined level, air flow through said air passage is restricted less than air flow through said second air outlet.

* * * * *